US005870483A

United States Patent [19]

Wong et al.

[11] Patent Number: 5,870,483

[45] Date of Patent: Feb. 9, 1999

[54] SOUND INSULATING CAP FOR SOUND LEVEL METERS

[75] Inventors: George S. K. Wong, Gloucester, Canada; Noland L. Lewis, Belmont, Calif.

[73] Assignee: National Research Council of Canada, Ottawa, Canada

[21] Appl. No.: 803,798

[22] Filed: Feb. 24, 1997

Related U.S. Application Data

[60] Provisional application No. 60/012,319, Feb. 27, 1996.

[51] Int. Cl.[6] ..... H04R 25/00

[52] U.S. Cl. ..... 381/189; 381/169

[58] Field of Search ..... 381/168, 169, 381/189, 155, 91

[56] References Cited

U.S. PATENT DOCUMENTS

| | | | |
|---|---|---|---|
| 2,556,168 | 6/1951 | Cragg et al. | 381/168 |
| 4,975,966 | 12/1990 | Sapiejewski | 381/168 |
| 5,444,790 | 8/1995 | Kogen | 381/168 |

*Primary Examiner*—Sinh Tran
*Attorney, Agent, or Firm*—Juliusz Szereszewski

[57] ABSTRACT

A sound-insulating cap is designed for conventional microphones without EMI protection. In an environment where EMI is likely to affect the performance of a conventional microphone, the cap is used to eliminate a substantial part of the acoustic noise and thus assess whether EMI is present during the measurements using the microphone. The cap has a member snugly fitting over the receptor of a microphone, the member made of a number of layers of acoustically different materials. Venting is provided to prevent a damage to the membrane of the microphone during the installation and removal of the cap.

8 Claims, 2 Drawing Sheets

SOUND INSULATING CAP FOR SOUND LEVEL METERS

FIELD OF THE INVENTION

This is a provision application Ser. No. 60/012,319 filed Feb. 27, 1996.

This invention relates to an electromagnetically transparent cap or cover for a microphone or another acoustical measuring system, the cap or cover having acoustically insulative properties.

BACKGROUND OF THE INVENTION

It is well known that the performance of a conventional microphone or, generally, a sound lever meter or acoustical measuring system may be affected by electromagnetic interference (EMI) which may be present in the area of interest as a result of electromagnetic radiation From various sources. Most of existing sound level meters are affected by EMI. More advanced sound meters are equipped with EMI shields. For conventional meters, lacking such protection, it is desirable to assess the effect of EMI on a sound level meter to minimize the resulting systematic measurement error. The more advanced sound level meters (SLMs) are also much more expensive than conventional SLMs.

To assess the presence of EMI and its effect on a sound level meter that has inadequate EMI protection, the level of sound reception must be significantly reduced if not totally eliminated (which is very difficult). An acoustic insulation is needed which would be practically transparent to electromagnetic interference while removing a significant portion of the acoustic signal bandwidth. For practical considerations, a reduction of at least 30 dB would be sufficient.

Various devices are known for protecting a microphone (SLM) from dust or atmospheric conditions. U.S. Pat. No. 3,652,810 is exemplary of such arrangements. They are not designed for sound insulation. On the contrary, the measured sound level should not be significantly reduced by such shields.

It is therefore an object of the invention to provide an acoustically insulative, EMI transparent device suitable for acoustically insulating a sound level meter, typically a conventional microphone having a membrane transducer.

It is another object of the invention to provide a reasonably simple and inexpensive acoustically insulative, EMI transparent device which would provide acoustic insulation of at least 30 dB for most standard SLMs.

SUMMARY OF THE INVENTION

In accordance with the invention, there is provided an acoustically shielding device for a sound level meter having a signal receptor, the device comprising:

at least one member having a cavity and shaped to be detachably mounted on the signal receptor such as to snugly envelop the receptor within the cavity, the member being of an acoustically insulative, electromagnetically transparent material, the acoustic impedance of the material selected to cover at least a substantial part of an acoustic bandwidth to be screened out, and, preferably, acoustically insulative pressure equalization, or venting, means for allowing pressure to equalize compared to the ambient pressure during the mounting of the at least one member onto the receptor or its removal.

The pressure equalization means should be such as to substantially prevent acoustic signals from affecting the sound level meter when the device is mounted thereon. For instance, the means may be a labyrinth-shaped channel of a small diameter, sufficient to transmit air therethrough during the insertion or removal of the device but not large enough to transmit acoustic signals to a significant degree.

Preferably, the at least one member has different acoustic insulation properties (acoustic impedance) across its thickness such as to cover a relatively wide bandwidth corresponding to the expected external acoustic noise.

The device may comprise two or more members placed one over the other in a multi-layer arrangement, possibly with additional material between the layers.

Preferably, the at least one member may comprise a layer of an elastic or resilient material adapted to yield resiliently under pressure, to facilitate the mounting of the device onto the receptor and the snug fit.

BRIEF DESCRIPTION OF THE DRAWINGS

In the drawings which illustrate the invention in more detail.

DETAILED DESCRIPTION OF THE INVENTION

Typical conventional sound level meters have microphones equipped with diaphragm transducers. The diaphragms are sensitive to pressure changes. It is important therefore to ensure that no sudden pressure build-up nor drop occurs during the insertion (mounting) or removal of a sound insulating device onto such a microphone.

Microphones have typically a standard diameter at the receptor, e.g. 0.25, 0.5, or 1 inch. It is therefore easy to manufacture a few types of the device of the invention dimensioned to fit a specific microphone size.

It may be difficult to predetermine the acoustic bandwidth to be screened out by the device of the invention. However, it has been found that the performance of the device is significantly improved if the device is made of a material having acoustic insulative properties over a broad frequency range as compared to a material with a narrow insulative range. Hence, it is preferable, according to the invention, to either make the device of a material which has a variable acoustic insulation properties across its thickness or combine a number of layers of materials having different insulating frequency ranges as opposed to a single acoustically homogeneous material.

It is well known that the thickness of an acoustic shield will play a role in its performance. However, due to technical and economical limitations, it is well desirable to keep the thickness within reasonable limits without unduly compromising the acoustic performance.

Figure 1A:
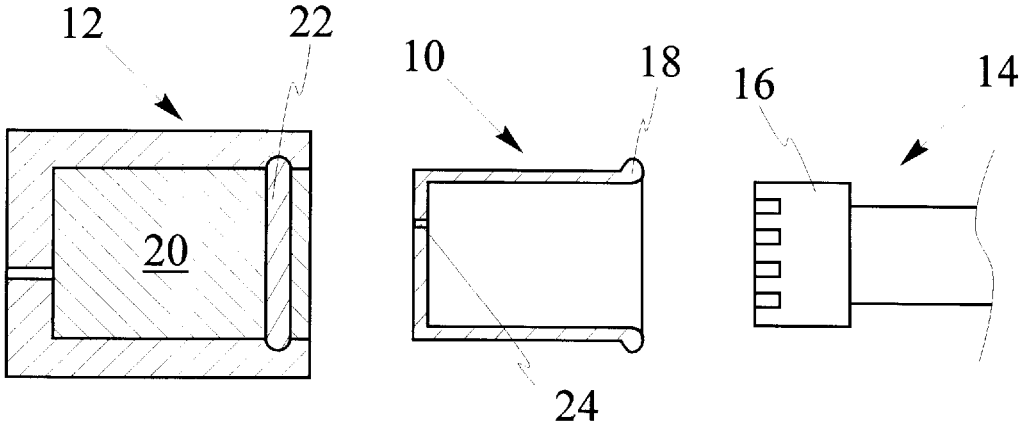
FIG. 1*a* is a cross-sectional exploded view of an embodiment of the device.
Figure 1B:
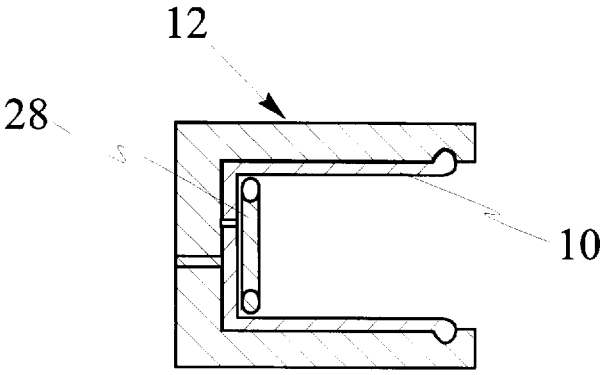
FIG. 1*b* is a cross-sectional view of the assembled device of FIG. 1*a*.

Turning now to FIG. 1*a*, an exemplary sound insulation protector of the invention is illustrated having two components, an inner cap 10 and an outer cap 12. The inner cap 10 is made of relatively elastic PVC, rubber or another yieldable material, such as not to damage the microphone during mounting while effectively shield it acoustically. The inside diameter of the inner cap 10 is such that when inserted over the microphone 14, the inner cap will snugly fit over the receptor part of the microphone 14 so as to acoustically shield the grid 16. To explain the term "snugly", it is not necessary that the shield adhere to the entire surface of the receptor as long as the grid is acoustically screened. As will be mentioned hereinbelow, a spacing between the grid and the bottom of the cavity of the member (practically the inner cap 10) may actually be advantageous to the acoustic properties of the device.

The inner cap 10 has a circumferential lip 18 the purpose of which will be explained hereinbelow.

The outer cap 12 is made of a different material than the inner cup, for example from ABS (acrylo-butadiene-styrene) and is dimensioned to receive the inner cup within its cavity 20. A circumferential groove 22 is provided in the cavity 20 and disposed such as to receive the lip 18 when the inner cap is inserted tightly into the cavity of the outer cap.

The inner cap 10 has a venting channel 24. The outer cap 12 also has a venting channel 26. The positioning of the channels is selected such that when the inner cup is mounted within the outer cap, the channels are offset from each other to prevent a straight acoustic path to form. Further, the material of at least one of the cups may be elastic enough to close the respective venting channel when the device is on the microphone, and open the channel under air pressure when the device is being mounted or removed. It will be understood that such mounting or removal should still be effected slowly enough for the pressure to equalize within the cavity of the device (inner cap 10) without damaging the membrane of the microphone 14.

It will be understood that the number of the layers defined by the caps 10, 12 may be greater, each such layer preferably having a different acoustic impedance.

In the embodiment illustrated, the microphone has an ½" receptor. The inner cap 10 has a thickness of about 1/16", and the outer cap 12 has a thickness of about 4 mm. The venting channel in the inner cap is made by a pin, while the venting channel in the outer cap has a diameter of about 0.3 mm.

To install the device, the inner cap is inserted slowly onto the microphone receptor and then the resulting assembly is slowly pushed into the cavity of the outer cap 12. The lip 18 will engage the groove 22 and thus the two caps will be "locked". This provision is to prevent the detachment of the two caps during the use of the device or an inadvertent loss of one of the components.

Figure 2:
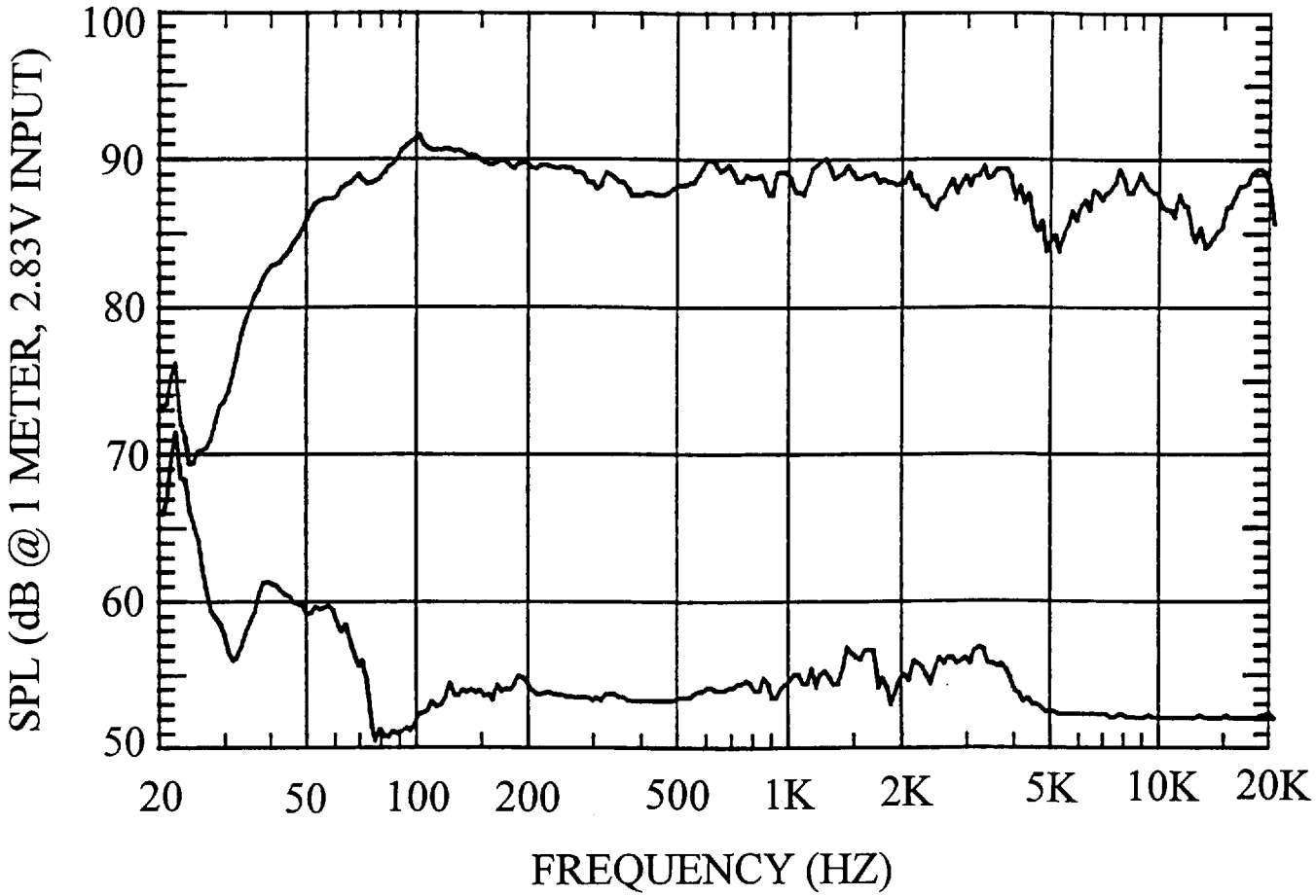
FIG. 2 is a graph illustrating the acoustic performance of the device.

As seen in FIG. 2, the device exhibits satisfactory acoustic insulation properties (about 30–35 dB). It has been found that a single layer of any of the two materials with the thickness equal to that of the embodiment illustrated (about ¼") will only provide an inferior acoustic insulation (about 20 dB) than the device of the invention.

The air volume between the microphone diaphragm and the microphone protective grid 16 influences the effectiveness of the sound insulating cap of the invention. Depending on the microphone type, by adjusting the inner volume, or spacing, between the front face of the microphone (the surface of the grid 16) and the bottom of the cavity of the member (which in the embodiment illustrated is the bottom of the inner cap 10), the acoustical insulating properties of the device may be enhanced. For a possible further improvement in acoustical insulation, as illustrated in FIG. 1*a*, a spacer ring 26 having a thickness of about 1–3 mm may be tightly placed at the bottom of the inner ring 10 (or, generally, the bottom of the cavity of the cap of the invention). The presence of such ring or another suitable spacer element will create an additional air space beyond the space in the front part (between the membrane and the grid) of the microphone. This increase in air space may enhance the acoustical insulation of the device. In the tests, improvements of 6 to 10 dB have been observed depending on the thickness of the spacer and the the type of the microphone. Some routine experimentation may be necessary.

We claim:

1. An acoustically shielding device for a sound level meter having a signal receptor, the device comprising:

at least one member having a cavity and shaped to be detachably mounted on the signal receptor such as to snugly envelop the receptor within said cavity, the member being of an acoustically insulative, electromagnetically transparent material, the acoustic impedance of said material selected to cover at least a subtantial part of an acoustic bandwidth to be screened out of the signal receptor.

2. The device of claim 1 wherein the acoustic impedance of the material varies across its thickness.

3. The device of claim 1 further comprising pressure equalization means for allowing pressure to equalize compared to the ambient pressure during the mounting of the at least one member onto the receptor or its removal therefrom.

4. The device of claim 3 wherein said pressure equalization means are acoustically insulative means.

5. The device of claim 3 wherein said pressure equalization means is a labyrinth-shaped channel.

6. The device of claim 1 wherein said at least one member comprising two layers of acoustically different materials.

7. The device of claim 1 wherein said at least one member comprises a layer of an elastic or resilient material adapted to yield resiliently under pressure, to facilitate the mounting of the device onto the receptor and the snug fit therewith.

8. The device of claim 1 further comprising a spacer in said cavity, said spacer disposed to define a space between said microphone receptor and the bottom of said cavity when said receptor is placed within said cavity of said device.

* * * * *